US009464844B2

(12) United States Patent
Sprague

(10) Patent No.: US 9,464,844 B2
(45) Date of Patent: Oct. 11, 2016

(54) END SEAL FOR OXIDATION OVEN

(75) Inventor: Philip Sprague, North Ridgeville, OH (US)

(73) Assignee: C.A. LITZLER CO. INC., Cleveland, OH (US)

( * ) Notice: Subject to any disclaimer, the term of this patent is extended or adjusted under 35 U.S.C. 154(b) by 712 days.

(21) Appl. No.: 13/575,797

(22) PCT Filed: Jan. 28, 2011

(86) PCT No.: PCT/US2011/023027

§ 371 (c)(1),
(2), (4) Date: Sep. 19, 2012

(87) PCT Pub. No.: WO2011/094615

PCT Pub. Date: Aug. 4, 2011

(65) Prior Publication Data

US 2013/0059261 A1 Mar. 7, 2013

Related U.S. Application Data

(60) Provisional application No. 61/299,439, filed on Jan. 29, 2010.

(51) Int. Cl.

| | |
|---|---|
| ***F24F 9/00*** | (2006.01) |
| ***F27D 7/04*** | (2006.01) |
| ***F24C 15/32*** | (2006.01) |
| ***F24C 3/00*** | (2006.01) |
| ***D01F 9/32*** | (2006.01) |
| ***F27B 9/28*** | (2006.01) |
| ***H05B 3/64*** | (2006.01) |
| ***F27B 9/30*** | (2006.01) |
| ***F27D 99/00*** | (2010.01) |

(52) U.S. Cl.

CPC . *F27B 9/28* (2013.01); *D01F 9/32* (2013.01); *F27B 9/30* (2013.01); *F27D 99/0075* (2013.01)

(58) Field of Classification Search

None

See application file for complete search history.

(56) References Cited

U.S. PATENT DOCUMENTS

| | | | | |
|---|---|---|---|---|
| 2,950,098 | A * | 8/1960 | Ruff | 432/72 |
| 3,727,324 | A * | 4/1973 | Melgaard | B65B 53/063 34/216 |
| 3,904,506 | A * | 9/1975 | Carmichael | C23C 14/568 204/192.26 |
| 3,925,182 | A * | 12/1975 | Carmichael | C23C 14/568 118/718 |
| 4,094,627 | A * | 6/1978 | Milton, Jr. | F27B 9/10 34/242 |

(Continued)

OTHER PUBLICATIONS

International Search Report for Application No. PCT/US2011/023027 dated Sep. 27, 2011.

*Primary Examiner* — Gregory Huson
*Assistant Examiner* — Eric Gorman
(74) *Attorney, Agent, or Firm* — Pearne & Gordon LLP

(57) ABSTRACT

Provided is an oven that includes an oven chamber with an oven wall that defines apertures through which the product passes to repeatedly enter and exit the oven chamber during treatment. A vestibule chamber is disposed adjacent to the oven wall and encloses a return air duct that draws in ambient air entering the vestibule chamber and the process gas entering the vestibule chamber from the oven chamber through at least one of the apertures in the oven wall. A nozzle is provided externally of the vestibule chamber and oven chamber in fluid communication with the return air duct. The nozzle receives gas drawn in by the return air duct and directs the combination generally toward at least one aperture formed in the vestibule chamber through which ambient air can enter the vestibule chamber to form an air curtain adjacent to the at least one aperture.

13 Claims, 5 Drawing Sheets

(56) References Cited

U.S. PATENT DOCUMENTS 4,100,004 A * 7/1978 Moss et al. ..... 156/60
4,125,365 A * 11/1978 Nelson ..... 432/152
4,398,472 A 8/1983 Burke et al.
4,545,762 A * 10/1985 Arita et al. ..... 432/59
4,559,010 A * 12/1985 Katsuki et al. ..... 432/59
4,616,562 A * 10/1986 Kuechler ..... A21B 3/04 126/299 R
4,815,397 A * 3/1989 Minnie, Jr. ..... 110/223
5,131,841 A * 7/1992 Smith ..... A21B 1/48 126/21 A
5,230,460 A * 7/1993 Deamborsio et al. ..... 228/180.1
5,333,774 A * 8/1994 Mishina et al. ..... 228/46
5,582,912 A * 12/1996 McCullough et al. ..... 428/367
5,908,290 A * 6/1999 Kawamura et al. ..... 432/59
6,007,465 A * 12/1999 Kawamura ..... D01F 9/32 432/60
3,027,337 A 2/2000 Rogers et al.
6,027,337 A * 2/2000 Rogers et al. ..... 432/64
6,313,444 B1 * 11/2001 Sprague ..... F26B 3/283 219/388
6,323,462 B1 * 11/2001 Strand ..... F27B 9/029 219/388
6,533,217 B2 * 3/2003 Lind ..... 242/615.12
6,776,611 B1 * 8/2004 Sprague ..... 432/64
7,004,753 B2 * 2/2006 Stockhausen ..... 432/59
7,335,018 B2 * 2/2008 Yamaguchi ..... 432/59
7,921,841 B2 * 4/2011 McKee et al. ..... 126/21 A
2002/0192391 A1 * 12/2002 Wada ..... B08B 7/0057 427/508
2004/0192187 A1 * 9/2004 Ashley ..... F24F 9/00 454/191
2007/0137633 A1 * 6/2007 McFadden ..... 126/21 A
2008/0099008 A1 * 5/2008 Bolton et al. ..... 126/21 A
2010/0273121 A1 * 10/2010 Gleason ..... F27D 7/04 432/4
2015/0140217 A1 * 5/2015 Takahashi ..... C21D 1/74 427/321

* cited by examiner

END SEAL FOR OXIDATION OVEN

CROSS-REFERENCE TO RELATED APPLICATIONS

This application claims the benefit of U.S. Provisional Application No. 61/299,439, filed Jan. 29, 2010, which is incorporated in its entirety herein by reference.

BACKGROUND OF THE INVENTION

1. Field of the Invention

This application relates generally to a seal to be provided to an oxidation oven for minimizing the release of process gases from the oxidation oven into an ambient environment and, more specifically, to an end seal disposed externally of a vestibule chamber that captures process gases from an oven chamber and minimizes cold air infiltration into the oven chamber.

2. Description of Related Art

Conventional end seals such as that disclosed in U.S. Pat. No. 6,776,611 and used on oxidation ovens counter the oven process gas losses in the upper product slots due to the natural pressure increase inside the oven chamber, an effect referred to as the "chimney effect." However, conventional end seals tend to introduce significant amounts of air having a temperature that is significantly less than the temperature of process gases used to treat product fibers within the oven chamber. The relatively-cool air introduced into the oven chamber can result in temperature gradients that can potentially cause non-uniformities across the product fibers. Further, process gases exposed to the relatively-cool air introduced by the end seals are prone to condensing within the oven chamber and forming a condensate referred to as "tar." Tar can accumulate within the oven chamber and degrade performance of the end seals. Thus, tar is removed periodically, requiring the oxidation oven to be shut down for a period during which production is lost.

To minimize the discharge of process gases into an ambient environment of the oxidation oven, a vestibule has typically been provided to an external side of the end seal, separated from the oven chamber by the end seal. However, the fiber passes repeatedly enter and exit the vestibule to be routed through the oven chamber, thereby elevating the temperature within the vestibule. The elevated temperature in the vestibule causes an elevated pressure therein that can force air out of the vestibule into the ambient, lower-pressure environment. To counter this problem, conventional oxidation ovens typically increase the rate at which the gases are exhausted from the vestibule and delivered to a scrubber or other treatment system for disposing of the exhausted process gases. However, the greater the rate at which the process gases are exhausted from the vestibule the greater the amount of process gases that must be treated for disposal. And while lowering the temperature within the conventional vestibule can minimize the pressure rise, such a condition promotes the undesirable formation of tar therein.

BRIEF SUMMARY

According to one aspect, the subject application involves an oven that includes an oven chamber through which a product passes to be treated. The product is to be exposed to a desired processing temperature and a process gas within the oven chamber. An oven wall defines a plurality of apertures through which the product passes to enter and exit the oven chamber. A vestibule chamber is disposed adjacent to the oven wall and is at least partially separated from the oven chamber by the oven wall. The vestibule chamber includes at least one aperture through which ambient air enters the vestibule chamber from an ambient environment of the oven. A return air duct disposed within the vestibule chamber draws in an air curtain gas including a portion of at least one of: (i) the process gas entering the vestibule chamber from the oven chamber through at least one of the plurality of apertures defined by the oven wall, and (ii) the ambient air entering the vestibule chamber from the ambient environment, wherein the process gas is at an elevated temperature relative to the ambient air. A nozzle is disposed externally of the vestibule chamber adjacent to the at least one aperture of the vestibule chamber and in fluid communication with the return air duct to receive at least a portion of the air curtain gas drawn in by the return air duct and to direct the air curtain gas generally toward the at least one aperture of the vestibule chamber to form an air curtain adjacent to the at least one aperture. The air curtain is directed generally toward the at least one aperture to interfere with the flow of at least one of the process gas and the ambient air outward into the ambient environment from the vestibule chamber through the at least aperture of the vestibule chamber.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
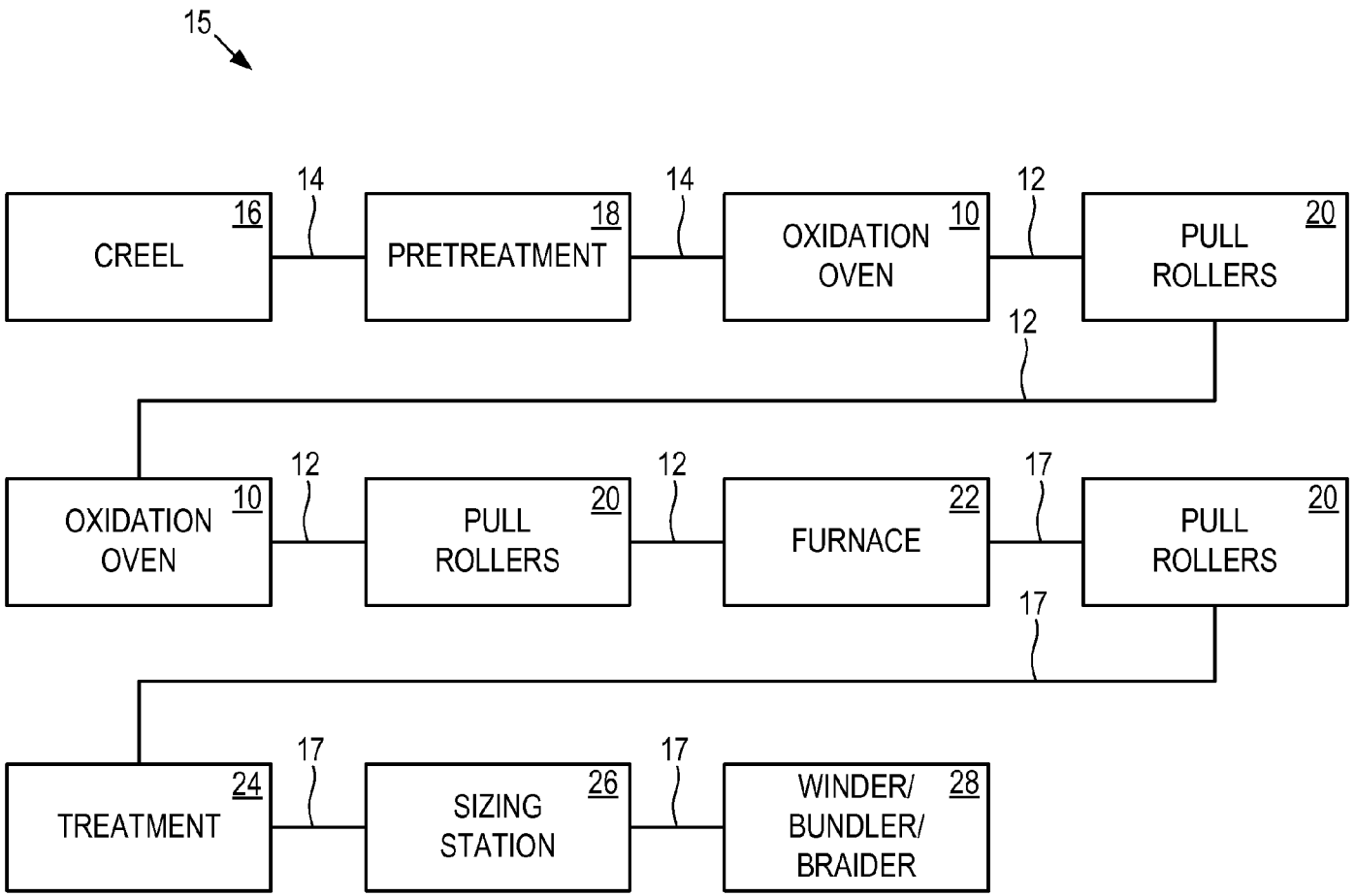
FIG. 1 is an illustrative embodiment of a process for production of a carbon fiber product.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Referring to the embodiment of a production facility 15 shown in FIG. 1, the present invention generally relates to an oxidation oven 10 used to treat a product, and a method of oxidizing a product. For example, the product can be in the form of elongated fibers, cords, webs or other continuous, elongated products that are to make multiple passes through the oxidation oven 10 during a treatment procedure. However, for the sake of brevity, the oxidation oven 10 appearing in FIG. 1 will be described as being used to convert polyacrylonitrile ("PAN") fibers 14 into oxidized PAN fibers 12, which eventually become a finished product in the form of carbon fiber filaments 17 after being subjected to additional processing steps following oxidation in the oxidation oven 10. For the examples set forth below, the product entering the one or more oxidation ovens 10 will be referred to as PAN fibers 14, the product exiting the oxidation ovens 10 will be referred to as oxidized PAN fibers 12, and the final product exiting a furnace 22 or other portion of the production facility 15 to be collected as the finished product will be referred to herein as carbon fibers 17.

As shown in FIG. 1, in the form of a block diagram, the production facility 15 includes a creel 16 that is used to unwind and dispense the PAN fibers 14 that are to be processed within the oxidation ovens 10 into the oxidized PAN fibers 12, and eventually collected as the carbon fibers 17. Multiple PAN fibers 14 are simultaneously dispensed by the creel 16 to form sheets, bands, tows or webs of PAN fibers 14. After the PAN fibers 14 are unwound, they are passed through a pretreatment device 18, such as a tension stand having a plurality of rollers, as is well known in the art. The PAN fibers 14 are then fed into a series of oxidation ovens 10. The oxidation ovens 10 can optionally include a plurality of oven chambers 32*a*, 32*b* that can be stacked in pairs as shown in more detail in FIGS. 2 and 3. A series of pull rollers 20 are positioned adjacent to each longitudinal end of the oven 10 to draw the fibers in multiple passes through the ovens 10 and maintain a desired tension as the fibers pass through the oven 10. One or more of the pull rollers 20 may be driven so as to cause the fibers to travel at a desired velocity through the oven 10. Other of the pull rollers 20 may be passive, rotating to allow the fiber to change make the transition when exiting and re-entering the oven 10 while maintain the tension of the fibers. The number of ovens 10 employed during production depends on the specific PAN fibers 14 being oxidized, the number of PAN fibers to be oxidized and the processing requirements for processing those fibers. An example of a system for oxidizing PAN fibers 14 is described in detail in U.S. Pat. No. 6,776,611 to Sprague, which is incorporated in its entirety herein by reference.

The oxidized PAN fibers 12 emerging from the oxidation ovens 10 can optionally be subjected to further heat treatment in one or more furnaces 22, after which the product emerges as the carbon fibers 17. Next, the carbon fibers 17 are treated by a surface treatment apparatus 24 and then a sizing station 26, which typically includes a dryer. The carbon fibers 17 are then wound using a winder 28 and/or bundled into groups of fibers called a toe. Each toe contains hundreds or thousands of individual carbon fibers 17. Multiple toes are typically braided or weaved together, often with other elements, including strength members or elastic members. As one skilled in the art will appreciate, other processing apparatus and/or additional pretreatment devices 18 or pull rollers 20 may be employed as needed in the production facility 15. An example production facility that includes oxidation ovens for the manufacture of carbon fibers 17 from a PAN precursor is described in U.S. Pat. No. 4,100,004, which is incorporated in its entirety herein by reference.

Figure 2:
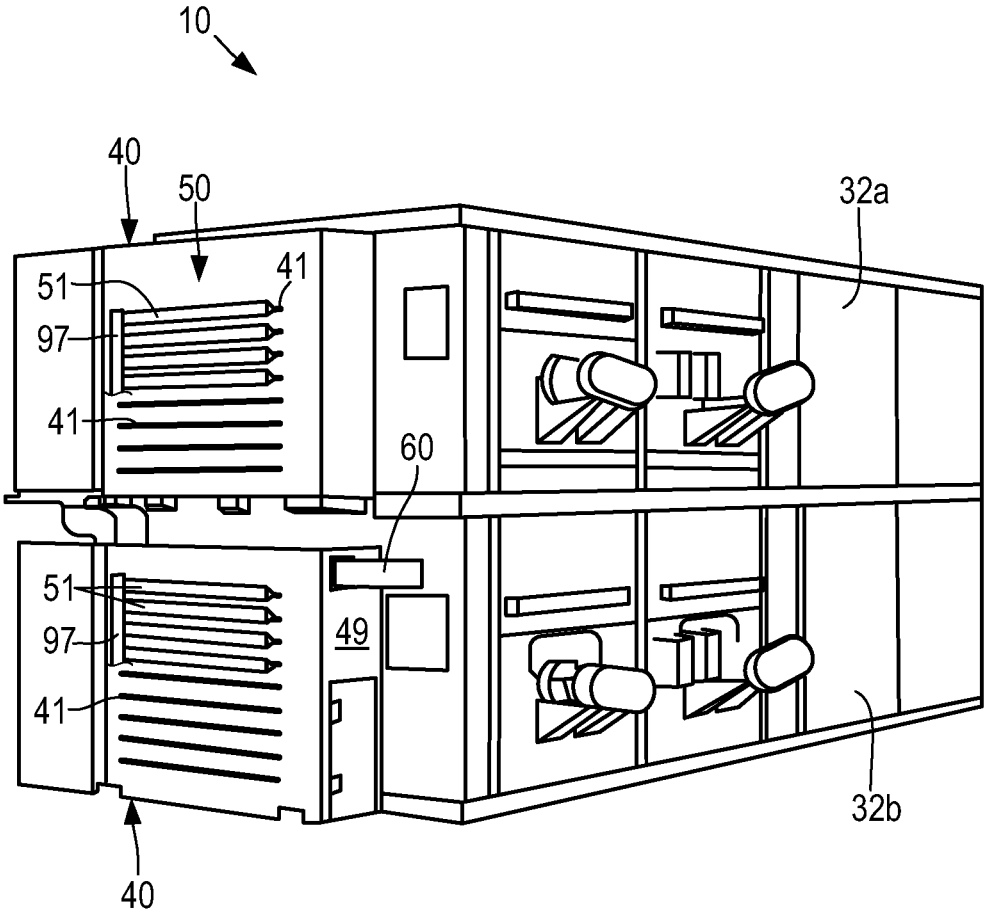
FIG. 2 is a perspective view of an illustrative embodiment of an oxidation oven including a pair of stacked oven chambers and an end seal provided to each oven chamber to minimize an amount of process gases escaping from its respective oven chamber.

An embodiment of an oxidation oven 10 defining a plurality of oven chambers 32*a*, 32*b* is shown in FIG. 2. As shown, the oxidation oven 10 includes a vestibule chamber 40 provided adjacent to the entrance and exit of apertures 47 (FIG. 4) extending longitudinally through the oven chambers 32*a*, 32*b* and through which the PAN fibers 14 pass while undergoing oxidation. Pull rollers 20 (FIG. 3), allow the PAN fibers 14 to repeatedly enter and exit the oven chambers 32*a*, 32*b*.

The vestibule chamber 40 at each end of the oven 10 includes a plurality of elongated and transversely-oriented apertures 41 leading to an interior 45 (FIG. 3) of the vestibule chamber 40. An end seal 50 assembly including a plurality of nozzles 51 is disposed externally of each vestibule chamber 40 and positioned to direct an air curtain gas 57 described below generally toward the apertures 41. At least one, and optionally a plurality of nozzles 51 can be arranged to direct the air curtain gas 57 toward each of the apertures 41, but several such nozzles 51 have been omitted from FIG. 2 to reveal the underlying apertures 41 that would otherwise be concealed from view. Further, the rollers 20 appearing externally of the vestibule chamber 40 in FIG. 3 have also been removed to expose the portions of the end seal 50, such as the nozzles 51, appearing in FIG. 2. Ambient air 44 (FIG. 6) from the ambient environment of the oxidation oven 10 can also be induced into the interior 45 of the vestibule chamber 40 through the openings 41 by the air curtain gas 57 supplied by the nozzles 51 via the venture effect. Once inside the interior 45 of the vestibule chamber 40, the ambient air 44 and air curtain gas 57 are combined with process gases 61 (FIG. 5) from the oven chambers 32*a*, 32*b* and eventually returned to the nozzles 51 via a conduit 97 such as a metallic duct, for example, to be used as the air curtain gas 57 as described in detail below to form an air curtain directed toward the apertures 41. The air curtains generated by the nozzles 51 of the end seals 50 interferes with gases escaping from the vestibule chamber 40 through the apertures 41. The flow rate of air curtain gas 57 from the nozzles 51 of the end seals 50 to form the air curtains can be adjusted to eliminate any loss of process gas 61 from the apertures 41 in the vestibule chamber 40, while producing an inward flow of ambient air 44 and/or air curtain gas 57 into vestibule chamber 40. The PAN fibers 14 pass through the apertures 47 in the oven chambers 32*a*, 32*b* to be exposed to elevated temperatures and process gases 61 and are converted into the oxidized PAN fibers 12 upon leaving the oven 10.

Figure 3:
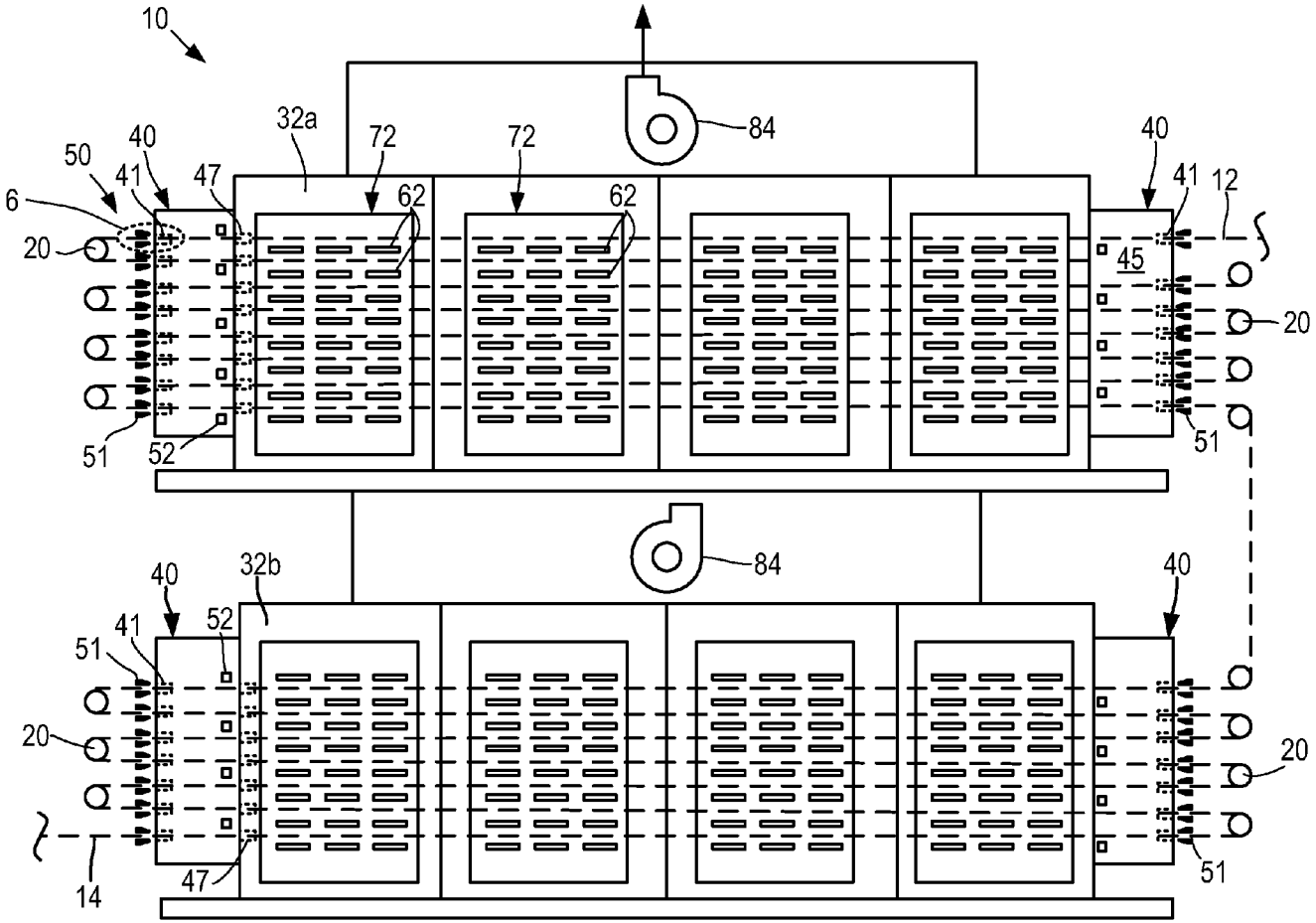
FIG. 3 is a partially cutaway view of an illustrative embodiment of an oxidation oven for treating a product as the product is passed through the oxidation oven a plurality of times.

FIG. 3 shows an illustrative example of an oxidation oven 10 partially cut away to expose a pair of oven chambers 32*a*, 32*b* in which the PAN fibers 14 are oxidized into oxidized PAN fibers 12, webbed product, or other elongated product that can be continuously conveyed and subjected to heat treatment. The oxidation oven 10 shown in FIGS. 2 and 3 includes an upper oven chamber 32*a* and a lower oven chamber 32*b*. The PAN fibers 14 are introduced to the lower oven chamber 32*b* and are turned about the pull rollers 20 so that the PAN fibers 14 make multiple passes through the lower oven chamber 32*b* of the oxidation oven 10 before then making multiple passes through the upper oven chamber 32*b* while undergoing oxidation. Thus, the PAN fibers 14 enter and exit the oxidation oven 10 multiple times before oxidation is complete and the oxidized PAN fiber 12 product emerges. The heated process gas 61 to which the PAN fibers 14 are exposed within the oven chambers 32*a*, 32*b* is blown across the PAN fibers 14 from vents 62 in the form of apertures formed in supply plenums 72 disposed within the oven chambers 32*a*, 32*b*. The heated process gases 61 can be blown in a transverse direction that is substantially perpendicular to the direction in which the PAN fibers 14 travel through the oven chambers 32*a*, 32*b*. The directions in which the PAN fibers 14 travel back and forth through the oven chambers 32*a*, 32*b* are indicated generally by arrow 42 in FIG. 5.

To minimize the escape of process gases 61 from the apertures 41 leading into the vestibule chamber 40, the nozzles 51 of the end seal 50 are provided outside of, and adjacent to each vestibule chamber 40 at both ends of the oxidation oven 10. The plurality of nozzles 51 are in fluid communication with a plurality of seal air return ducts 52 disposed within the vestibule chamber 40. Ambient air 44 that has entered the vestibule chamber 40 and heated process gas 61 that has entered the interior 45 of the vestibule chamber 40 from the oven chambers 32*a*, 32*b* are combined and drawn in by the seal air return ducts 52 as the air curtain gas 57. At least a portion of the air curtain gas 57 drawn in by the seal air return ducts 52 is to be transported through the conduit 97 to the nozzles 51, which direct the air curtain gas 57 generally toward the apertures 41 leading into the vestibule chamber 40.

Figure 6:
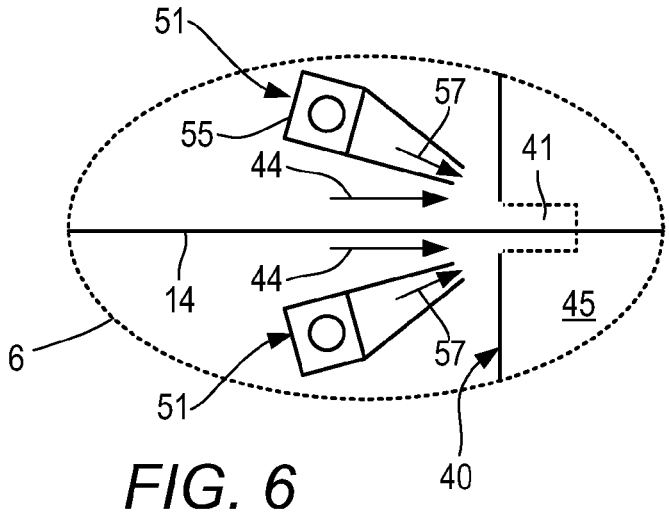
FIG. 6 is an enlarged view of an encircled region of the oxidation oven appearing in FIG. 3.
Figure 5:
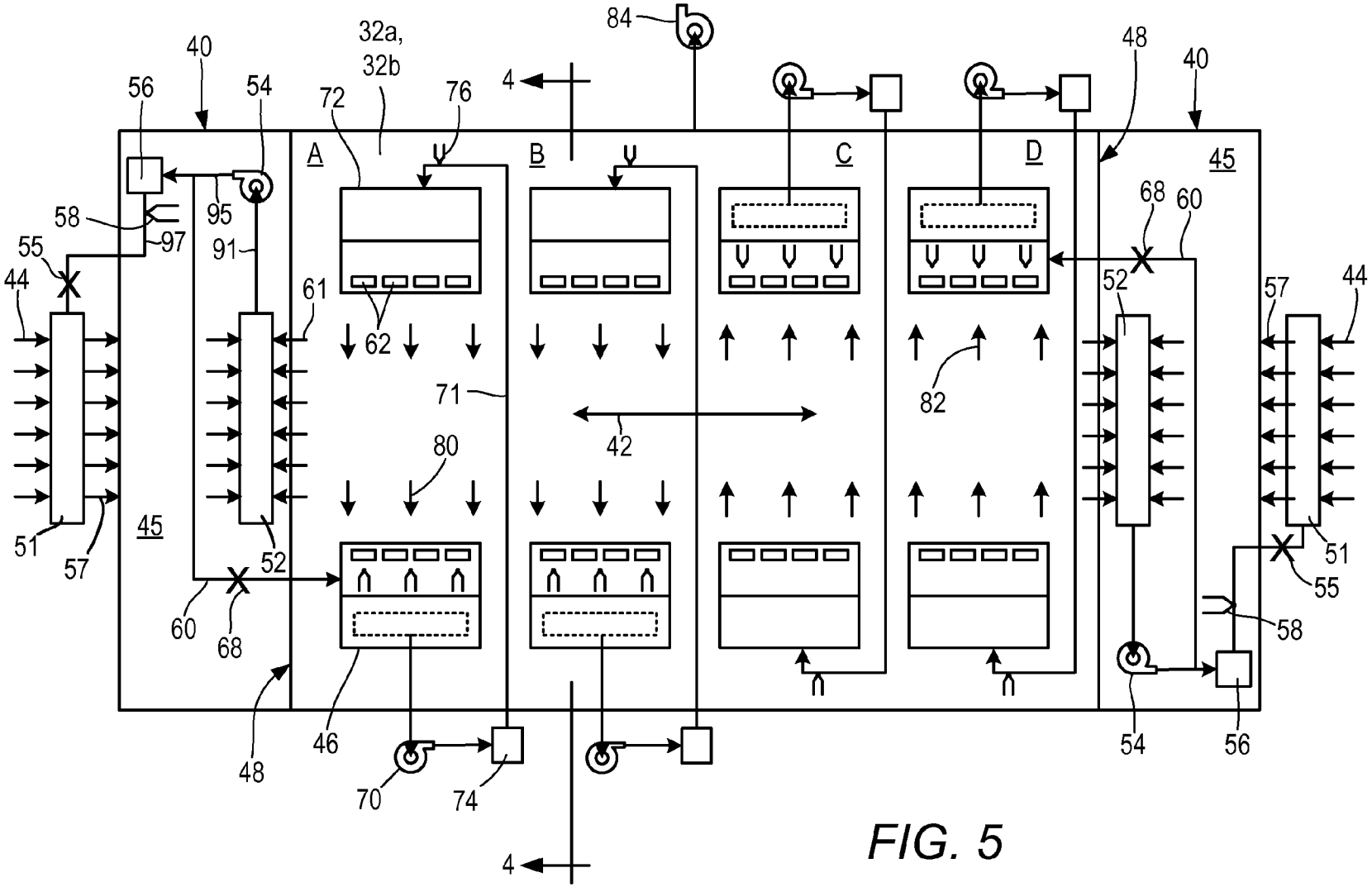
FIG. 5 is a top view of an illustrative embodiment of one an oxidation oven including an end seal that includes a set of nozzles disposed within a vestibule chamber.

The uppermost nozzle 51 of an end seal 50 is shown from above in the top and partially cutaway view of the oxidation oven 10 appearing in FIG. 5, and in the side view of the encircled portion 6 in FIG. 3, which is enlarged in FIG. 6. Each nozzle 51 can be a transversely oriented "bar" that extends along a substantial portion of the apertures 41 that lead into the interior of the vestibule chamber 40. Being disposed outside of the vestibule chamber 40, the nozzles 51 are readily accessible for cleaning and servicing. Each of the nozzles 51 can optionally be removably secured to a frame coupled to the oven with removable fasteners such as bolts or other threaded fasteners, clamps, etc. . . . that can be replaced to reinstall the nozzles 51 on the oven 10. According to alternate embodiments, the nozzles 51 can optionally be removably coupled to a frame that is placed next to, but independent of the oven 10.

The nozzles 51 each include an independently-controlled damper 55 that is adjustable to control the flow rate of air-curtain gas 57 through the nozzle 51 to limit the quantity of process gases 61 escaping the vestibule chambers 40. Like the nozzles 51, the damper 55 is also located outside of the vestibule chamber 40, and is accessible to be adjusted from the ambient environment of the oxidation oven 10, even while the oxidation oven 10 is in use to oxidize the PAN fibers 14. The dampers 55 can optionally be individually hand adjustable from the ambient environment, or can optionally be computer controlled based on a feedback routine, or a user-selected control routine entered into a control terminal for example. The term nozzle 51 is used herein generally to refer to a conduit through which a stream of air, process gases 61, or a combination thereof travels to be imparted in a general direction of an aperture 41. Although optional, the nozzles 51 do not necessarily require a taper or constriction to change the velocity of the air curtain gas 57 flowing there through. Further, a single nozzle 51 and damper 55 combination can optionally be arranged adjacent to each aperture 41 leading into the interior 45 of the vestibule chamber 40.

The nozzles 51 supply the air-curtain gas 57 and, by the venturi effect, induce a positive flow of the ambient air 44 inward through the openings 41 (FIG. 2) in the vestibule chamber 40. The sum of the horizontal flow components of the air-curtain gas 57 and the ambient air 44 can be tuned or optimized to be equal, substantially equal or greater in magnitude, but opposite in direction, relative to flow components of the gases that would otherwise escape the vestibule chamber 40 as a result of a pressure gradient in the direction exiting the vestibule chamber 40. The mass flow rate (and therefore pressure head) of the air curtain gas 57 and ambient air 44 can be tuned or controlled by independently regulating the air curtain gas 57 flow rate via the adjustable dampers 55.

It will be understood that for a given pressure adjacent to each aperture 41 of the vestibule chamber 40, the air curtain gas 57 and ambient air 44 flow rates (and resulting pressure head) can be tuned or adjusted to achieve an approximate zero pressure gradient condition across those apertures 41. The result is an effective air seal for each aperture 41 that interferes with the escape of process gases 61 from the oven vestibule chamber 40. According to alternate embodiments, the damper 55 provided to each nozzle 51 of the end seal 50 is independently adjustable to establish a small infiltration rate of the combined air curtain gas 57 and ambient air 44 into the vestibule chamber 40 to maintain seal effectiveness taking into account normal process variations. A flow rate of the combined ambient air 44, air curtain gas 57 and process gas 61 recovered by the return air duct 52 through bypass return air duct 60 is controlled by damper 68 as required to optimize the temperature uniformity inside the oven chamber 32*a*, 32*b* over its height. The bypass gas transported through the bypass return air duct 60 is supplied to a return air plenum 46 to be eventually returned to the oven chambers 32*a*, 32*b*.

The vestibule chamber 40 is an enclosure that can optionally be partitioned from the interior of each oven chamber 32*a*, 32*b* by a perforated and insulated wall 48, shown in FIG. 5, that forms an insulated barrier enclosing each longitudinal end of the respective oven chambers 32*a*, 32*b*. The perforations 47 in the insulated wall 48 leading into oven chambers 32*a*, 32*b* allow the PAN fibers 14 to enter and exit the oven chambers 32*a*, 32*b* during oxidation.

For the embodiment shown in FIG. 5, ambient air 44 drawn in from the ambient environment of the oxidation oven 10, air curtain gas 57 and process gases 61 that have entered the vestibule chamber 40 from the oven chambers 32*a*, 32*b* are combined within the vestibule chamber 40. This combination is drawn in by the plurality of seal air return ducts 52 disposed within the vestibule chamber 40 draw at least a portion of the combined ambient air 44, air curtain gas 57 and process gases 61 from within the vestibule chamber 40. A separate seal air return duct 52 can optionally be disposed between each of the PAN fiber 14 passes entering and exiting the oven chambers 32*a*, 32*b* or optionally arranged in any other desired manner. According to alternate embodiments, at least one seal air return duct 52 can be provided to supply each nozzle 51 with the combined ambient air 44, air curtain gas 57 and process gases 61. According to yet other embodiments, a seal air return duct 52 can be provided to supply more than one nozzle 51 with the combined ambient air 44, air curtain gas 57 and process gases 61 from within the vestibule chamber 40. The gases drawn in by the seal air return ducts 52 is delivered to a recirculation fan 54 that is operatively connected in fluid communication with the seal air return ducts 52 to be at least partially returned to the interior 45 of the vestibule chamber 40 as the air curtain gas 57. The recirculation fan 54 can optionally be a plug type blower, and can optionally be integrally installed in, and extend through, an insulated wall 49 (FIG. 2) of the vestibule chamber 40, for example. The gas combination exhausted from the recirculation fan 54, or at least a portion thereof, is introduced to a recirculation heater 56, which can be an electric resistance heater, for example, or other suitable type of heater. Operation of the recirculation heater 56 can be controlled in response to a target set temperature of the air curtain gas 57 to be delivered by the recirculation fan 54 to the nozzles 51 and a temperature of the air curtain gas 57 sensed by a thermocouple 58 or other suitable temperature sensor. The temperature of the air curtain gas 57 and the ambient air 44 being recirculated by the recirculation fan 54 can optionally be controlled through operation of the recirculation heater 56 based on the set temperature and the temperature sensed by the thermocouple 58.

To minimize temperature gradients within the oven chambers 32*a*, 32*b* due to the introduction of relatively-low temperature gas therein from the end seal 50, at least one of the recirculation fan 54, the recirculation heater 56, the nozzles 51, the return air ducts 52, and at least one of the conduits (e.g., ducts 91, 95, 97 in FIG. 5) operatively connecting and establishing fluid communication between such components can be substantially entirely disposed within the vestibule chamber 40. According to alternate embodiments, a substantial length, and optionally a majority of the length of the conduits 91, 95, 97 connecting and establishing fluid communication between the seal air return ducts 52 and the nozzles 51 can be disposed within the vestibule chamber 40. Including such components within the vestibule chamber 40 minimizes the exposure of the gases drawn in by the seal air return ducts 52 to the relatively-low temperature of the ambient environment before being delivered to the nozzles 51. Substantially maintaining the temperature of the gases drawn in by the seal air return ducts 52 by exposing the conduits and optionally the other components to the interior 45 of the vestibule chamber 40 or other portion of the oven 10 lessens the burden on the recirculation heater 56 to elevate the temperature of the gases as the air curtain gas 57 to a desired temperature before being emitted by the nozzles 51. In other words, ducting the gases drawn in by the seal air return ducts 52 externally of the vestibule chamber 40 and oven chambers 32*a*, 32*b* can expose those gases to the relatively-low temperature of the ambient environment. This exposure can result in the gases drawn in by the seal air return ducts 52 experiencing a temperature drop that would not otherwise occur, or is of a greater magnitude than a temperature drop that would occur without ducting or otherwise significantly exposing the gases drawn in by the seal air return ducts 52 to the relatively-low temperature of the ambient environment. Minimizing the temperature drop in this manner minimizes the burden on the recirculation heater 56 to elevate the temperature of the air curtain gas 57 to be approximately equal to that of the process gases 61 to which the PAN fibers are exposed within the oven chambers 32*a*, 32*b* or other desired set temperature.

The air curtain gas 57 including the ambient air 44 combined with the process gases 61 collected by the seal air return ducts 52 is delivered to the recirculation heater 56 followed by the nozzles 51. The air curtain gas 57 is expelled through the end nozzles 51 as required to oppose the internal pressure of the gases within the vestibule chamber 40. The dampers 55 can be independently adjusted to control the air curtain gas 57 flow rate at each specific elevations of the plurality of nozzles 51 that collectively form a portion of the end seal 50. To minimize a temperature gradient between the air curtain gas 57, and accordingly, a temperature within the vestibule chamber 40, and the internal temperature of the oven chambers 32*a*, 32*b*, the recirculation heater 56 can be operated to elevate the temperature of the air curtain gas 57, as sensed by the thermocouple 58, to a temperature approaching, and optionally about as high as the temperature of the process gas 61 within the oven chambers 32*a*, 32*b*. The internal temperature of the oven chamber 32*a*, 32*b* can be sensed by another thermocouple or other suitable temperature sensor, or based on a set target temperature of the oven chamber 32*a*, 32*b*.

The net mass flow rate of gases, such as process gases 61 from the oven chambers 32*a*, 32*b*, the air curtain gas 57 and the ambient air 44 for example, entering the vestibule chamber 40 in excess of the mass flow rate of gases from the seal air return ducts 52 returned to the nozzles 51 can be exhausted from the vestibule chamber 40 as bypass gas that is returned to the oven chamber 32*a*, 32*b* via the bypass return air duct 60. The exhaust rate can be set by adjustment of a damper 68 that regulates the flow rate of gases through the bypass return air duct 60. Further, the exhaust rate can be set by adjustment of damper 68 as required to obtain the optimum temperature uniformity inside the oven chambers 32*a*, 32*b*. Like the dampers 55 provided to regulate the flow rate through the nozzles 51, the damper 68 can optionally be accessible, and hand adjustable from the ambient environment, even while oxidation of the PAN fibers 14 is being performed with the oxidation oven 10. Again, to minimize a temperature drop experienced by gases flowing through the return air duct 60, a majority, substantially all, or the entire length of the return air duct 60 can be disposed internally of the oven the oven 10, such as within the vestibule chamber 40, within the oven chambers 32*a*, 32*b*, or a combination thereof. For the embodiment appearing in FIG. 2, an elbow of the bypass return air duct 60 extends externally of the oven 10 between the vestibule chamber 40 and a return air plenum 46 (FIGS. 4 and 5), which is disposed within the oven chamber 32*b*. However, a greater portion, and substantially all of the return air duct 60 for the embodiment shown in FIG. 2 is disposed within the vestibule chamber 40 and oven chamber 32*b*. For the embodiment shown in FIG. 5, the entire return air duct 60 is disposed within the oven 10.

Just as with the conduits 91, 95, 97 connecting the seal air return ducts 52, recirculation heater 56 and nozzles 51, enclosing the return air ducts 60 within the oven 10 minimizes the temperature drop experienced by the bypass gas flowing through the return air ducts 60 before being returned to the oven chambers 32*a*, 32*b*. Gases from the seal air return ducts 52 are diverted to the return air duct 60 before reaching the recirculation heater 56, but the temperature of such gases can be substantially maintained en route to the return air plenum 46 by being ducted substantially within the oven 10. Once delivered to the return air plenum 46, the bypass gas becomes part of the process gas 61 that can be heated via a plenum heater 74 described below before being introduced to the PAN fibers 14 within the oven chambers 32*a*, 32*b* via the supply plenum 72.

The supply plenums 72 mentioned above introduce the process gases 61 to which the PAN fibers 14 are exposed while undergoing oxidation within the oven chambers 32*a*, 32*b*. Each supply plenum 72 can be paired with a corresponding return air plenum 46 through which the process gases 61 are recovered after being exposed to the PAN fibers 14 within the oven chambers 32*a*, 32*b*. According to embodiments of the invention, a supply plenum 72 can be paired with a corresponding return air plenum 46 for each of a plurality of heating zones A, B, C and D, as shown in FIG. 5, arranged lengthwise within the oven chambers 32*a*, 32*b*. Although four heating zones A, B, C and D are shown, there can be one or a plurality comprising any desired number of heating zones for a given application.

The process gases 61, air curtain gas 57, ambient air 44, or a combination thereof from the vestibule chamber 40 and delivered to the return air plenum 46 can be removed from the return air plenum 46 through operation of a plenum fan 70 (FIGS. 4 and 5) and transported via ductwork 71 to the corresponding supply plenum 72. Again, including substantially all, or optionally the entire length of ductwork 71 between the return air and supply plenums 46, 72 within the oven 10, such as within the respective oven chambers 32*a*, 32*b* for example, the temperature drop of the returned gases (generally referred to as recovered gases 81) can be minimized to promote uniform temperatures widthwise across the oven chambers 32*a*, 32*b*. According to alternate embodiments, at least one of the plenum fan 70 and a plenum heater 74 that elevates the temperature of the recovered gases 81 can also optionally be disposed at least partially within the oven chambers 32*a*, 32*b* to minimize heat losses to the ambient environment. According to alternate embodiments, the plenum fan 70, plenum heater 74, or both are disposed externally of the oven chambers 32*a*, 32*b*, but at least a portion of the ductwork 71 connecting them is exposed to the elevated temperatures within the oven chambers 32*a*, 32*b*. Further, the flow rate of the recovered gases 81 introduced to the oven chambers 32*a*, 32*b* through which the PAN fibers travels during oxidation can be independently regulated by adjustable dampers 77. The adjustable dampers 77 can also optionally be accessible, and manually adjustable from the ambient environment of the oxidation oven 10, even during operation of the oxidation oven 10.

Figure 4:
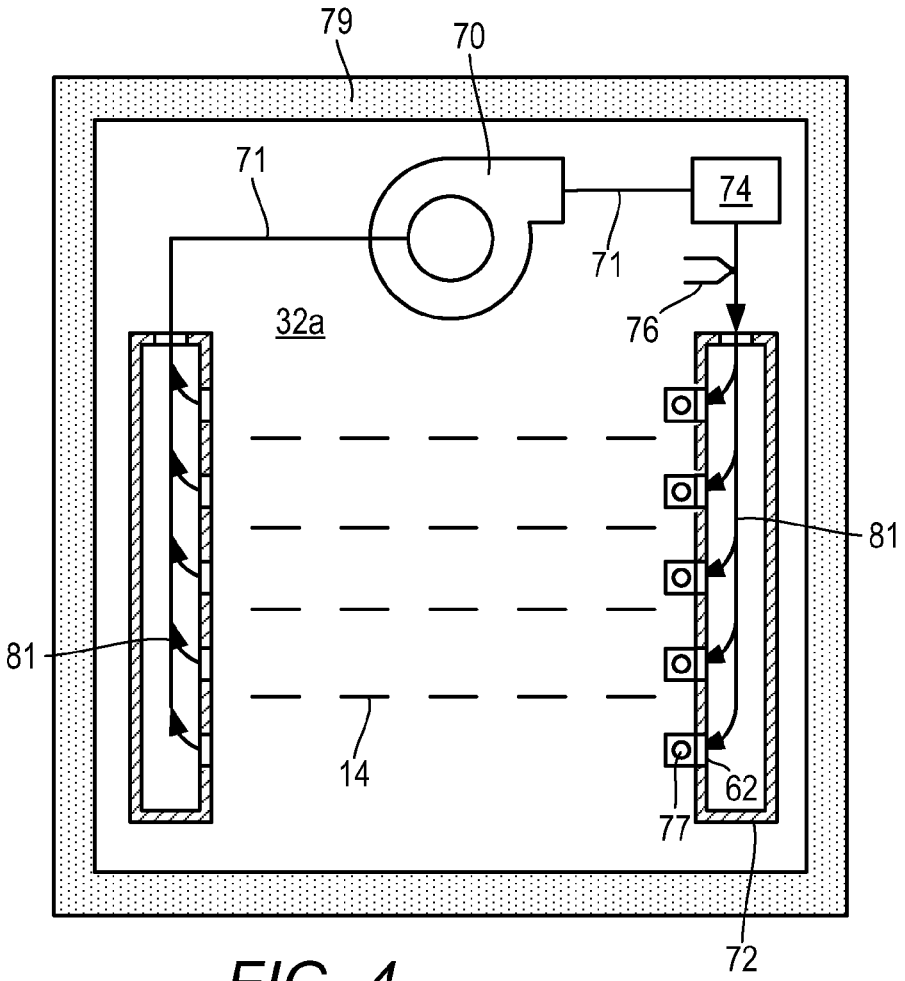
FIG. 4 is a cross-sectional view taken along line 4-4 in FIG. 5.

As shown in FIG. 4, the plenum fan 70 and plenum heater 74 can be provided in communication with the ductwork 71 within the oven chambers 32*a*, 32*b* to elevate a temperature of the recovered gases 81 from the return air plenums 46 to be delivered to the supply plenum 72 and re-circulated as process gases 61 within the oven chamber 32*a*, 32*b*. Like the recirculation fan 54, the plenum fan 70 can optionally be installed in an insulated wall 79 of the oven chamber 32*a*, 32*b*, or otherwise disposed externally or internally of the oven chamber 32*a*, 32*b*. Similar to the recirculation heater 56, the plenum heater 74 can be controlled based on a temperature of the recovered gases 81 that are re-introduced into the oven chamber 32*a*, 32*b* via the supply plenum 72 as the process gas 61 and a desired set temperature by a thermocouple 76 or other suitable temperature sensor. A desired temperature of the process gas 61 to be introduced to the PAN fibers 14 during oxidation can be input by a user via a control panel or other suitable interface. The feedback from the thermocouple can be indicative of a difference between the temperature of the recovered gases 81 and the desired temperature specified by the user, and the plenum heater 74 operated accordingly to substantially resolve such difference.

The arrangement of the return air and supply plenum 46, 72 can establish any desired flow pattern of recovered gases 81 as the process gases 61. For the illustrative embodiment shown in FIG. 5, two pairs of return air plenums 46 and corresponding supply plenums 72 are arranged to direct recovered gases 81 as the process gas 61 over the PAN fibers 14 in one transverse direction 80. Likewise, another two pairs are arranged to direct recovered gases 81 as the process gas 61 over the PAN fibers 14 in the opposite transverse direction 82. Thus, the temperature gradients along a length of the oven chamber 32*a*, 32*b* parallel to the directions 42 that the PAN fibers 14 pass through the oven chamber 32*a*, 32*b* can be minimized. The plenum heater 74 provided for each zone can be independently controlled to keep the process gases 61 within a close tolerance of a target temperature set by an operator for the particular PAN fibers 14 or other product being treated.

For embodiments where the end seal 50 is adjusted to establish a small infiltration rate of the combined air curtain gas 57 and ambient air 44 into the vestibule chamber 40, an accumulation of gases within the oven chambers 32*a*, 32*b* can result in a pressure rise therein. Such a scenario can be avoided through operation of an exhaust fan 84, shown in FIG. 5, which moves the process gas 61 from the oven chambers 32*a*, 32*b* to be transported to scrubbing equipment or another abatement system that removes potential pollutants before venting the cleaned gas to a suitable environment for disposal, such as the atmospheric environment. According to alternate embodiments, an independent exhaust fan 84 can optionally be provided to each oven chamber 32*a*, 32*b* as shown in FIG. 3. Regardless of the number and configuration of the exhaust fans, however, the exhaust fan 84 is operable to establish a mass flow rate from the oven chambers 32*a*, 32*b* to address any accumulation of any mass flow of ambient air 44, other gas introduced into the oven chambers 32*a*, 32*b*, or a combination thereof. The oven chambers 32*a*, 32*b* are said to be s balanced when the mass flow into and out of the oven chambers 32*a*, 32*b* are substantially equal.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used, such term is intended to be inclusive in a manner similar to the term "comprising" as "comprising" is interpreted when employed as a transitional word in a claim.

What is claimed is:

1. An oven comprising:

an oven chamber through which a product passes to be treated, wherein the product is exposed to a desired processing temperature and a process gas within the oven chamber;

an oven wall defining a plurality of apertures through which the product passes to enter and exit the oven chamber;

a vestibule chamber that is adjacent to the oven wall and is at least partially separated from the oven chamber by the oven wall, the vestibule chamber comprising at least one aperture through which ambient air enters the vestibule chamber from an ambient environment of the oven;

a return air duct disposed within the vestibule chamber that draws in an air curtain gas comprising a portion of at least one of:

the process gas entering the vestibule chamber from the oven chamber through at least one of the plurality of apertures defined by the oven wall, and the ambient air entering the vestibule chamber from the ambient environment, wherein the process gas is at an elevated temperature relative to the ambient air; and at least one nozzle disposed externally of the vestibule chamber and separated from the oven chamber by the vestibule chamber, the at least one nozzle being located adjacent to the at least one aperture of the vestibule chamber and in fluid communication with the return air duct to receive at least a portion of the air curtain gas drawn in by the return air duct and to direct the air curtain gas generally toward the at least one aperture of the vestibule chamber to form an air curtain adjacent to the at least one aperture, wherein the air curtain interferes with the flow of at least one of the process gas and the ambient air outward into the ambient environment from the vestibule chamber through the at least aperture of the vestibule chamber, and the return air duct is in communication with the ambient environment to draw in a combination of the process gas and the ambient air as the air curtain gas to be directed by the at least one nozzle generally toward the at least one aperture of the vestibule chamber to form the air curtain.

2. The oven according to claim 1 further comprising an air mover disposed between the return air duct and the at least one nozzle to promote flow of the air curtain gas from the return air duct to the at least one nozzle.

3. The oven according to claim 2 further comprising a conduit that transports the air curtain gas between the return air duct and the at least one nozzle, wherein a substantial portion of the conduit is exposed to an elevated temperature within the vestibule chamber.

4. The oven according to claim 2 further comprising a heater disposed between the return air duct and the at least one nozzle to elevate a temperature of the air curtain gas delivered to the at least one nozzle to an elevated temperature that is greater than a temperature of the air curtain gas drawn in by the return air duct.

5. The oven according to claim 4, wherein the heater elevates the temperature of the air curtain gas to approximately the processing temperature within the oven chamber.

6. The oven according to claim 4 further comprising a temperature sensor that senses a temperature of the air curtain gas being delivered to the at least one nozzle and transmits a feedback signal indicative of the temperature sensed to control operation of the heater to achieve a predetermined target temperature.

7. The oven according to claim 2 further comprising an adjustable damper disposed between the air mover and the at least one nozzle to regulate a flow of the air curtain gas to the at least one nozzle to form the air curtain.

8. The oven according to claim 7, wherein the adjustable damper is in fluid communication with the at least one nozzle and is accessible to be adjusted from the ambient environment during operation of the oven.

9. The oven according to claim 1 further comprising:

a bypass conduit that bypasses the at least one nozzle and transports a bypass gas comprising a portion of the air curtain gas drawn in by the return air duct to a return air plenum exposed to an interior of the oven chamber, wherein substantially all of the bypass conduit extending between the return air duct and the return air plenum is exposed to an elevated temperature within at least one of the vestibule chamber and the oven chamber.

10. The oven according to claim 9 further comprising an adjustable damper that regulates a flow of the bypass gas to the return air plenum to be reintroduced into the oven chamber, wherein a magnitude of the flow established by adjustment of the adjustable damper promotes a substantially uniform temperature within the oven chamber.

11. The oven according to claim 9 further comprising a supply plenum in fluid communication with the return air plenum to receive the bypass gas from the return air plenum and introduce the bypass gas into the oven chamber as the process gas.

12. The oven according to claim 11 further comprising a return conduit for transporting the bypass gas between the return air plenum and the supply plenum, wherein substantially all of the return conduit is exposed to an interior of the oven chamber.

13. The oven according to claim 12 further comprising:

an air mover that imparts a force urging the bypass gas generally toward the supply plenum; and a plenum heater disposed along the return conduit to heat the bypass gas between the return air plenum and the supply plenum.

* * * * *